United States Patent [19]

Wendland

[11] Patent Number: 4,790,174

[45] Date of Patent: Dec. 13, 1988

[54] ADJUSTING DRIVE FOR INSERT TIGHTENERS OF PRESSES

[75] Inventor: Wilfried Wendland, Hilchenbach, Fed. Rep. of Germany

[73] Assignee: Firma Maschinenfabrik Hilma GmbH, Fed. Rep. of Germany

[21] Appl. No.: 53,137

[22] Filed: May 21, 1987

[30] Foreign Application Priority Data

May 30, 1986 [DE] Fed. Rep. of Germany ..... 3618286

[51] Int. Cl.[4] ..... B21D 37/14

[52] U.S. Cl. ..... 72/481; 72/462; 72/446; 100/918; 269/58

[58] Field of Search ..... 269/55, 58; 100/918, 100/35; 72/446, 448, 462, 481, 482; 83/678

[56] References Cited

U.S. PATENT DOCUMENTS

| | | | |
|---|---|---|---|
| 3,335,657 | 8/1967 | Clements | 100/35 |
| 4,674,315 | 6/1987 | Linz | 72/481 |
| 4,698,894 | 10/1987 | Lingaraju et al. | 72/481 |
| 4,718,339 | 1/1988 | Wymann | 100/918 |

*Primary Examiner*—David Jones

*Attorney, Agent, or Firm*—McGlew and Tuttle

[57] ABSTRACT

An adjusting device for fastening a die to the clamping face of a press ram having a T-groove communicating with the clamping face, comprises a flexible but longitudinally non-stretchable traction member which is either movably mounted or fixed to the press ram and which extends in the T-groove. A tenon block is operatively connected to the traction member and carries an insert tightener. A drive motor drives the traction member so as to move the tenon block and its insert tightener in the T-groove so that the insert tightener can engage a clamping edge of a die or upper tool for holding the die or upper tool against the clamping face of the press ram.

11 Claims, 5 Drawing Sheets

ADJUSTING DRIVE FOR INSERT TIGHTENERS OF PRESSES

FIELD AND BACKGROUND OF THE INVENTION

This invention concerns an adjusting drive for insert tighteners for fastening upper dies below the mounting table of a press ram.

U.S. Pat. No. 3,335,657 shows such an adjusting drive in which a spindle is mounted in the T-groove, which passes through a rotating but axially immovable threaded nut in a face plate jaw mechanically actuated by wedge surfaces, and is connected to a motor drive. More common than this are insert tighteners with hydraulically actuated face plate jaws, with these hydraulic insert tighteners not only hastening the tightening process and clamping the die more securely, but especially more accurately but with the spindle also being relieved of the tightening forces so that it can be of lighter design and is not subject to any wear that is caused by the stress of the high clamping forces. Adjusting drives are also known for insert tighteners in which the insert tightener is connected to drive elements by means of a roller thrust chain, with this roller thrust chain being supported by guide members in the T-groove so that it can transfer the compressive forces to push the insert tightener with the roller thrust chain into the tightening position and again pull it out of this position. Both spindle drives and roller thrust chain drives require either relatively large T-groove guides (weakening of the tie rod by the spindle bore) or a large structural space on the side of the press ram, so that the attachment of paneling becomes difficult and the space for moving handling equipment for transporting the workpiece is unnecessarily restricted.

On the other hand, the drive spindle or the roller thrust chain cannot be kept arbitrarily small, since they have to be of self-supporting design above the adjustment of path of the tightening element. Furthermore, known adjusting drives can only engage in the T-groove from one end, and have to have a cantilever design between the insert tightener and the bearing outside of the T-groove, because the smooth surfaces of the T-groove for guiding the tenon block must not be impaired.

SUMMARY OF THE INVENTION

It is the purpose of this invention to provide an adjusting drive as economically as possible, that provides for precise positioning of the insert tightener.

Accordingly an object of the present invention is to provide an adjusting drive or insert tighteners which are used for fastening dies beneath the clamping face of the press ram with a T-groove guide which the insert tightener engages with a tenon block, and in which it is moveable horizontally with a drive motor, comprising a traction member which is flexible around its longitudinal axis, carried in the T-groove passed the tenon block. The traction member is unstretchable and has no play in its direction of traction. The traction member is connected to the drive motor and to a counter bearing on the press ram.

Although basically flat chains, cables, or the like can also be used as traction mechanisms, a toothed belt with a flat cross section is proposed by the invention, that is located between the lateral head surfaces of the tenon block and the surfaces of the T-groove guide opposite them. A substantial inventive feature is found in this accommodation of the flat traction means between the lateral surfaces of the tenon block and the T-groove guide. Without impairment and without additonal labor cost in comparison with prior T-groove guides, space can be provided for accommodating the means of traction. This is done without the necessity of designing the surfaces on the top and on the stepped bottom of the tenon block that transfer the forces when tightening the die, any differently than in the past. Toothed belts made of high-strength plastic, or with embedded steel cords, are especially suitable, so that the toothed belt is unstretchable in the longitudinal direction but is otherwise flexible everywhere. Such a toothed belt can be produced economically and can optionally be bought as a commercial product. In comparison with adjusting drives of known design, an adjusting drive with the design features pursuant to the invention has the advantage of substantially more economical production, low weight, and especially also of more precise positioning of the insert tightener at the desired clamping point. To connect the toothed belt to the drive gear, it is recommended to loop the toothed belt around this drive gear by at least 180°, so that the toothed belt is guided over the drive gear by reversals in the manner of a secure pulley.

For the structural implementation of the method pursuant to the invention to solve the problem addressed, an endless guidance of the toothed belt can be provided, with the toothed belt at one end of the T-groove guide being fed over the drive gear of a drive unit fastened there, and at the other end over a turnaround located there in the T-groove guide, which thus comprises the counterbearing for the transmission of the traction forces in the toothed belt. This means that the ends of a finite portion of toothed belt that is laid on turnarounds at the ends of the T-groove guide are fastened to the tenon block. With this design, the drive unit can be fastened as before on one side at the head end of the T-groove guide, so that the toothed belt extends as an endless loop through the T-groove guide and is carried past both sides of the tenon block with its two strands.

In another version, a finite toothed belt is fastened at each of its ends, to the ends of the T-groove guide, so that it constitutes the counterbearing for the traction forces on the press ram, and is fed through a drive unit over a drive gear that is securely fastened to the tenon block. In this design, the drive unit moves synchronously with the tenon block and the insert tightener in the adjusting motion.

A still further object of the present invention is to provide an adjusting device for fastening a die to the clamping face of the press ram which is simple in design, rugged in structure and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

The drawing shows two embodiments of the invention, as follows.

DESCRIPTION OF THE PREFERRED EMBODIMENTS

Figure 1:
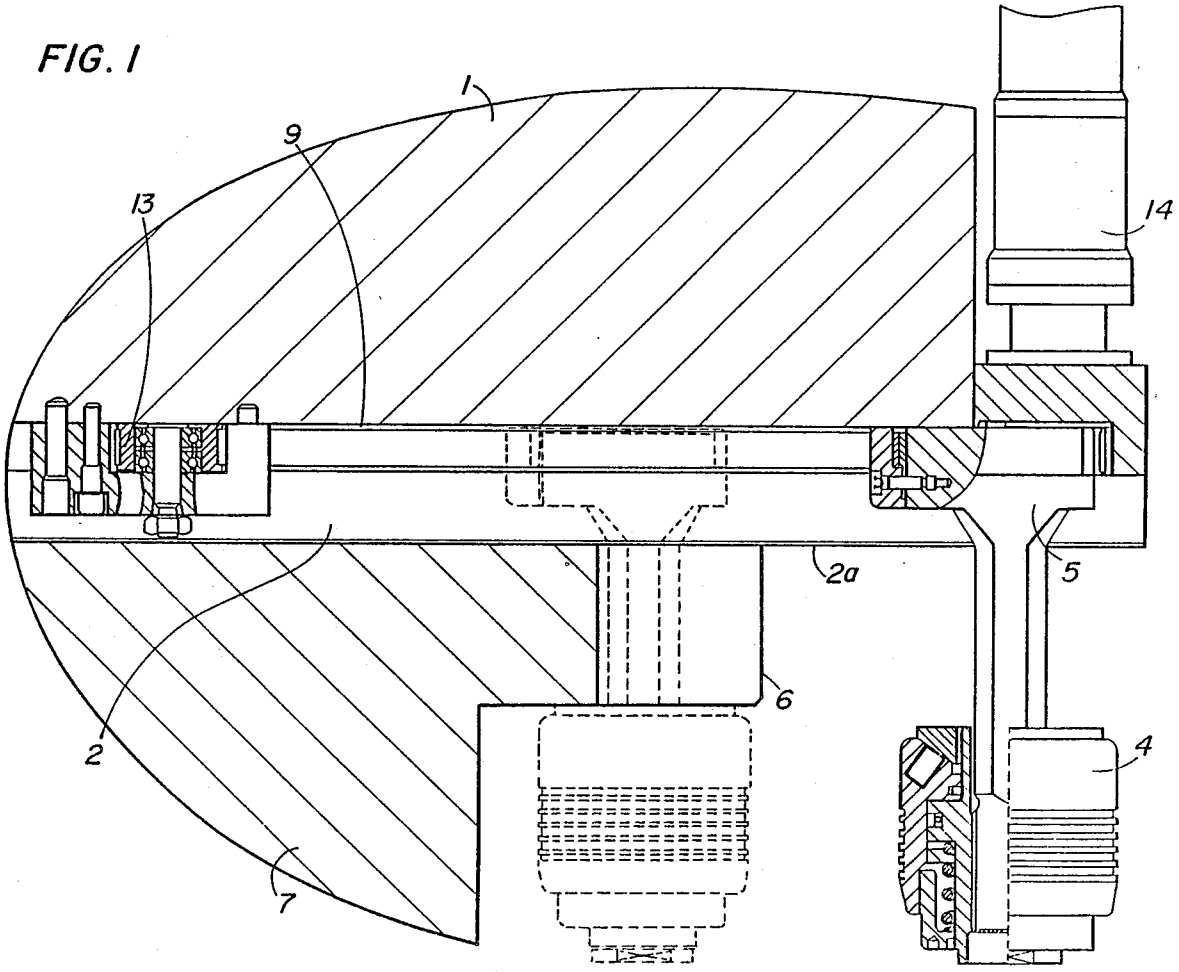
FIG. 1 is a vertical partial sectional view through a T-groove guide of a press ram with the inventive insert tightener and drive drive unit.
Figure 2:
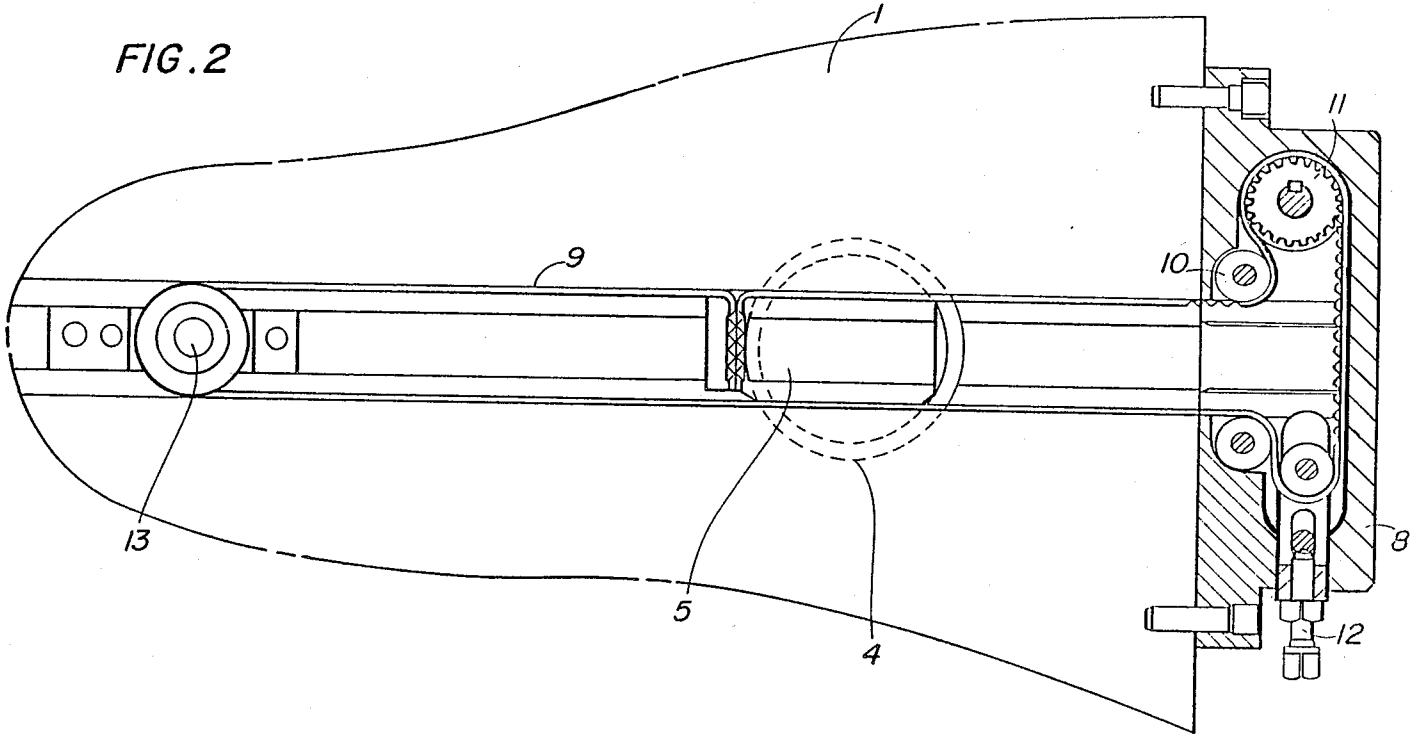
FIG. 2 is a plan view of the press ram with the T-groove according to FIG. 1, with a section taken through the drive unit.
Figure 3:
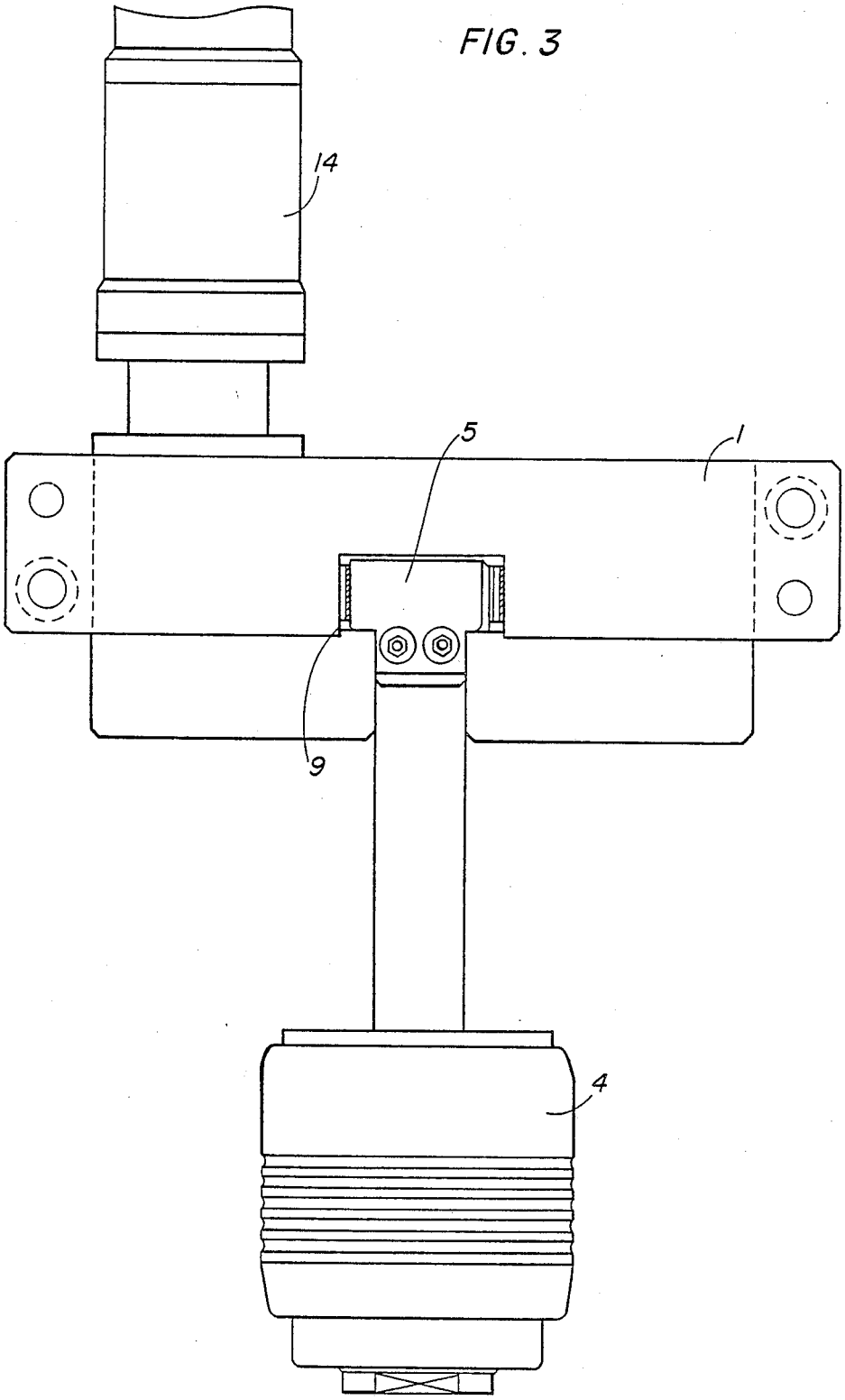
FIG. 3 is an elevational view of the example of FIGS. 1 and 2, taken from the left.

Referring to the drawings in particular, the invention embodied therein comprises an adjusting device for fastening a die to the clamping face of a press ram. The first embodiment of this invention is shown in FIGS. 1 through 3.

The press ram 1, or a comparable component of the press, has a T-groove 2 which is open to the clamping face 2*a* at its bottom, in which the insert tightener 4 with a tenon block 5 is engaged, and in which it can be moved back and forth horizontally. The insert tightener 4 in the case of the example is designed as a commercial, preferably hydraulically operated clamping element, and can be moved into the area of the clamping edge 6 of an upper tool or die 7 or the like by the horizontal adjustment of the tenon block 5 in the T-groove 2, in order to clamp firmly the clamping edge of the die by actuating the clamping element. The adjusting drive or traction means for the tenon block 5 of the insert tightener 4 is composed of a drive unit 8 and a toothed belt 9, that is guided endlessly in the drive unit fastened to the outside of the press ram 1, over turnarounds 10, a drive gear 11, and a clamping device 12. The toothed belt 9 extends with both strands between the side faces of the tenon block 5 and the side faces of the T-groove 2 opposite them, up to a turnaround 13 supported at the opposite end of the T-groove 2. By turning on the drive motor 14, the insert tightener 4, or optionally a clamping element of different design, can be moved out of the position shown with solid lines in FIG. 1 into the clamping position shown with broken lines, and back. Turnarounds 10 and 13 may be rollers. An electric motor is just as suitable a drive motor as a drive unit driven with a pressurized fluid.

Figure 4:
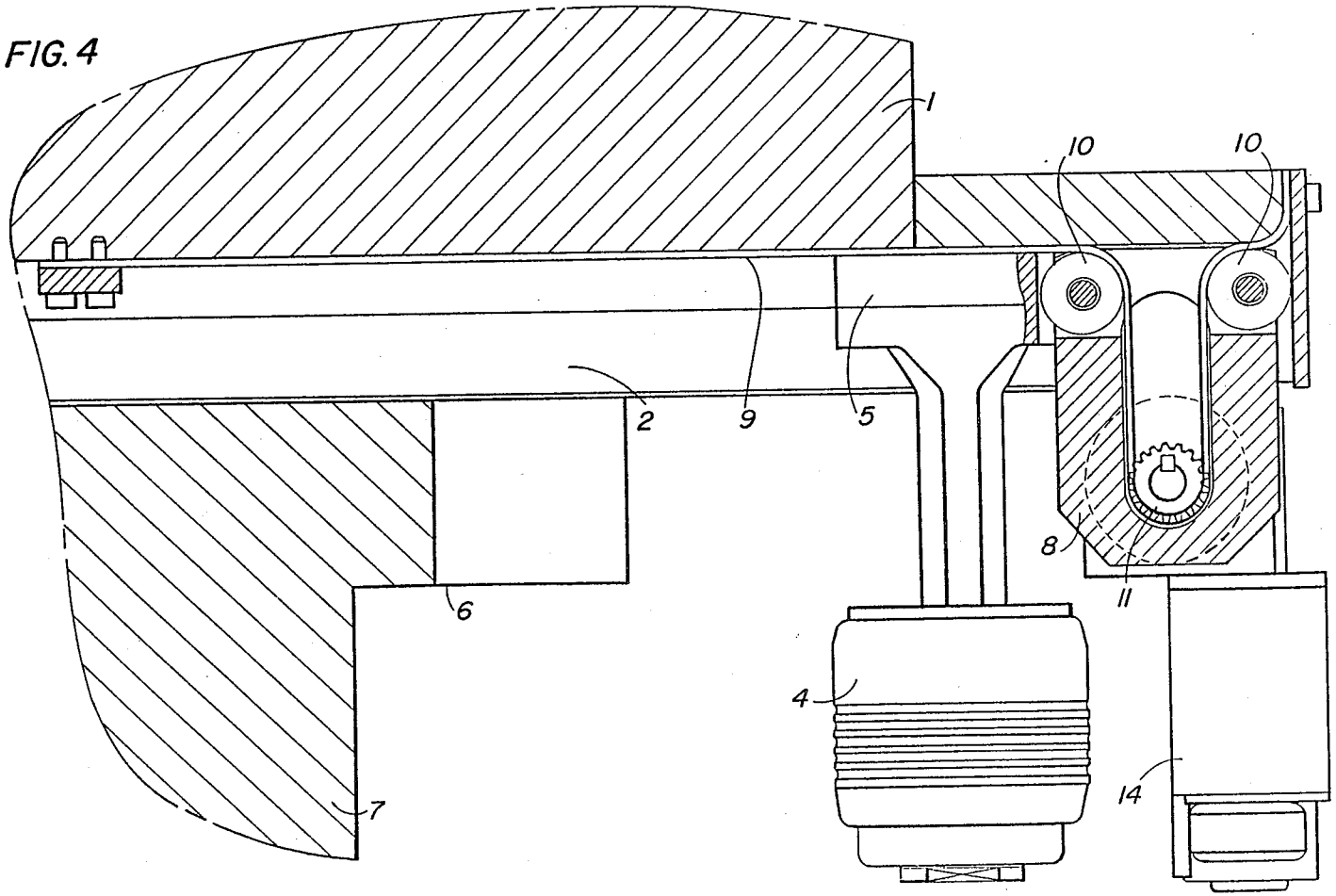
FIG. 4 is a sectional view corresponding to FIG. 1, but in a modified embodiment.
Figure 5:
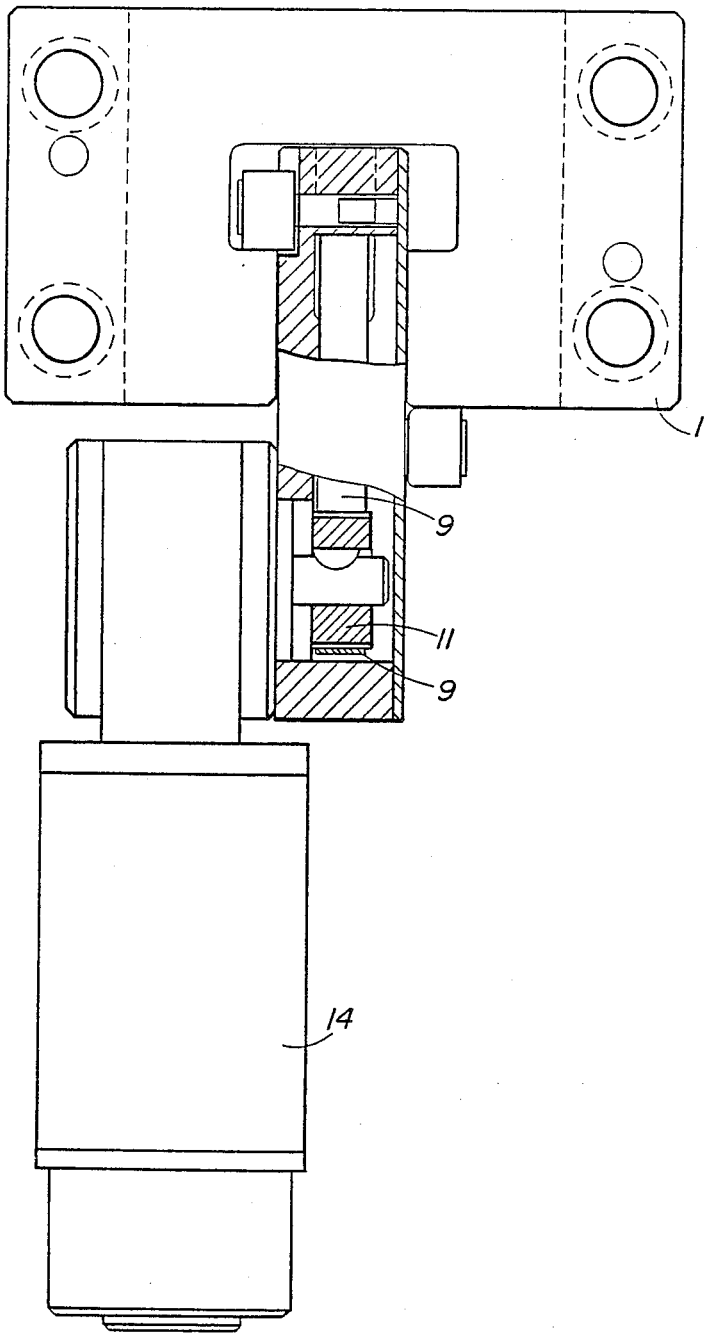
FIG. 5 is an elevational view of the example of FIG. 4 taken from the left, with a vertical sectional view taken through the drive unit.

In the embodiment according to FIGS. 4 and 5, where the same numbers are used to designate the same or functionally similar parts, a finite section of toothed belt is fastened by one end at the outer end of the T-groove 2 and by the other end at the inner end of the T-groove 2. The toothed belt 9 passes over turnarounds 10 and over the drive gear 11 and through the drive unit 8, which is connected in this embodiment to the tenon block 5, so that the drive unit 8 moves with the drive motor 14 together with the clamping device 4.

Although the inventive features were described in an adjusting drive for fastening upper does beneath the clamping surface of a press ram, their application is also suitable for clamping devices for fastening dies or workpieces to clamping tables or the like, if they have the generic design features of this type. The use of the inventive features is independent of the specific design of the clamping means for fastening the die, and is also independent of the method and manner of operation of these clamping means.

While specific embodiments of the invention have been shown and described in detail to illustrate the application of the principles of the invention, it will be understood that the invention may be embodied otherwise without departing from such principles.

What is claimed is:

1. An adjusting device for fastening a die to the clamping face of a press ram having a T-groove communicating with the clamping face, comprising a tenon block mounted for movement in the T-groove, traction means for moving the tenon block along said T-groove including a toothed belt which is flexible and unstretchable with respect to a longitudinal axis thereof, disposed in and extending along the T-groove, said tenon block being operably connected to said traction means for displacing said tenon block along the T-groove, an insert tightener connected to said tenon block and movable with said tenon block to engaging a die to hold the die against the clamping face, and a drive motor operably connected to said traction means for causing movement of said tenon block along the T-groove for engaging said insert tightener with a die for holding the die against the clamping face.

2. A device according to claim 1 wherein said traction means belt is a toothed endless belt having a flat cross section, said tenon block having lateral surfaces facing inner surfaces of the T-groove, said toothed belt having portions extending over each of said lateral surfaces of said tenon block.

3. A device according to claim 1 wherein said traction means belt is a toothed belt with a flat cross section, a drive gear being connected to said drive motor for rotation by said drive motor, said toothed belt being engaged around said drive gear, and at least one turnaround mounted at a fixed location with respect to the T-groove for engagement with said toothed belt to guide said toothed belt.

4. A device according to claim 3 wherein said toothed belt is endless, said turnaround being mounted for rotation at one end of the T-groove, said drive gear being mounted at an opposite end of the T-groove.

5. A device according to claim 1 wherein said toothed belt has one end fixed to the ram press at the one end of the T-groove and an opposite end connected to the press ram at an opposite end of the T-groove, said motor and drive gear being movable along the T-groove and being operatively connected to said tenon block along the T-groove and movement of each tenon block with respect to said toothed belt.

6. A device according to claim 3 wherein said toothed belt has opposite ends fixed to said tenon block to form an endless loop around said turnaround and said drive gear.

7. A device according to claim 6 including a drive unit fixed to the press ram at one end of the T-groove, said motor being mounted to said drive unit, at least one additional turnaround rotatably mounted to said drive unit and said drive gear being mounted to said drive unit, said toothed belt being engaged around said additional turnaround and said drive gear in said drive unit.

8. A method of moving an insert tightener for holding a die to the clamping face of a press ram, the press ram having a T-groove therein communicating with the clamp face, comprising extending a longitudinally flexible and unstretchable traction member including a toothed belt in the T-groove, operatively connecting a drive motor to the traction member operatively connecting a tenon block to the traction member for movement of the tenon block along the T-groove with actuation of the drive motor, the tenon block being fixed to the insert tighener, and activating the drive motor for moving the tenon block.

9. A method according to claim 8 including mounting the drive motor for movement along the traction member and for engaging and moving the tenon block with movement of the drive motor.

10. A method according to claim 8 including mounting the traction member for movement along the T-groove and operatively connecting the tenon block to the traction member for movement along the T-groove with movement of the traction member.

11. An adjusting device for fastening a die to the clamping face of a press ram having a T-groove communicating with the clamping face, comprising a tenon block mounted for movement in the T-groove, traction means for moving the tenon block along said T-groove including a toothed belt which is flexible and unstretchable with respect to a longitudinal axis thereof, disposed in and extending along the T-groove, said tenon block being operably connected to said traction means for displacing said tenon block along the T-groove, an insert tightener connected to said tenon block and movable with said tenon block to engaging a die to hold the die against the clamping face, and a drive motor operably connected to said traction means for causing movement of said tenon block along the T-groove for engaging said insert tightener with a die for holding the die against the clamping face, said traction means belt is a toothed belt with a flat cross section, a drive gear being connected to said drive motor for rotation by said drive motor, said toothed belt being engaged around said drive gear, and at least one turn-around mounted at a fixed location with respect to the T-groove for engagement with said toothed belt to guide said toothed belt.

* * * * *